United States Patent [19]

Leliaert et al.

[11] 4,378,662

[45] * Apr. 5, 1983

[54] AIRLESS CENTRIFUGAL BLAST DEVICE

[75] Inventors: Raymond M. Leliaert, South Bend; Richard C. Kanouse, Mishawaka; Bill J. Butler, Mishawaka; Robert N. Lindner, Granger, all of Ind.

[73] Assignee: Wheelabrator-Frye Inc., Hampton, N.H.

[ * ] Notice: The portion of the term of this patent subsequent to Jun. 17, 1997, has been disclaimed.

[21] Appl. No.: 149,156

[22] Filed: May 14, 1980

Related U.S. Application Data

[63] Continuation-in-part of Ser. No. 909,770, May 26, 1978, Pat. No. 4,207,711.

[51] Int. Cl.[3] ..... B24C 5/06; B24C 7/00

[52] U.S. Cl. ..... 51/432

[58] Field of Search ..... 51/431-435; 72/40, 53; 239/665; 241/275

[56] References Cited

U.S. PATENT DOCUMENTS

| | | | |
|---|---|---|---|
| 2,131,143 | 9/1938 | Quinn | 51/432 |
| 2,204,596 | 6/1940 | Hughes | 51/433 |
| 2,204,637 | 6/1940 | Unger | 51/432 |
| 2,341,559 | 2/1944 | Keefer | 51/432 |
| 2,363,437 | 11/1944 | Peterson | 51/432 |
| 4,207,711 | 6/1980 | Leliaert | 51/432 |

FOREIGN PATENT DOCUMENTS

| | | | |
|---|---|---|---|
| 538349 | 11/1931 | Fed. Rep. of Germany | 51/432 |
| 1015343 | 9/1957 | Fed. Rep. of Germany | 51/431 |
| 522676 | 8/1955 | Italy | 51/431 |
| 117608 | 11/1926 | Switzerland | 51/432 |
| 319278 | 10/1930 | United Kingdom | 51/429 |
| 238368 | 8/1967 | U.S.S.R. | 51/432 |

OTHER PUBLICATIONS

A. P. C. Application of Grocholl, Ser. No. 250446, published 4/43.

*Primary Examiner*—Stephen G. Kunin
*Assistant Examiner*—Robert A. Rose
*Attorney, Agent, or Firm*—McDougall, Hersh & Scott

[57] ABSTRACT

An airless centrifugal blast device in the form of a one piece, two-bladed wheel mounted for rotational movement about either a horizontally or vertically disposed axis and means for off center gravitational feed of particulate media to the inner end portions of the blades with the particulate media feed tube means tapering in cross section to the discharge opening and extension of the discharge opening in the direction of rotation of the wheel.

20 Claims, 12 Drawing Figures

AIRLESS CENTRIFUGAL BLAST DEVICE

This is a continuation-in-part of our copending application Ser. No. 909,770, filed May 26, 1978, and entitled "Airless Centrifugal Blast Device" now U.S. Pat. No. 4,207,711.

This invention relates to airless abrasive blast wheels for projecting metallic and non-metallic particulate media for impact upon surfaces in such processes as shot peening, descaling, deburring, and other abrasive blast applications.

The invention will be described with reference to a simple wheel formed of two blades extending diametrically in opposite directions from a central hub mounted on a motor driven, belt driven, or the like shaft for rotational movement about a central axis of the shaft. A centrifugal two-bladed airless blast wheel of the type described is marketed in this country under the name Delta type wheel. Features of this invention, such as the novel concepts for feeding the particulate media to the wheel, as will hereinafter be described, have applications to other types of single or multiple bladed wheels, wherein the particulate media is introduced for engagement with the inner portion of the blade surface for projecting from the ends thereof in response to centrifugal force imparted by rotation of the blades at high speed about the central axis.

Delta type wheels of the type heretofore produced have been found to be deficient in a number of respects. Blade change to replace worn out blades has been awkward and sometimes very difficult, and the mounted blades are inadequately supported on the central shaft. Further, the assembly is subject to vibrations, which bring about increased wear and reduction in strength of the assembly.

The feed from the tubes used to introduce the particulate media into the path of the blades provides for an erratic flow rate which not only reduces the output efficiency of the wheel but results in lack of control of the blast pattern.

It is an object of this invention to provide an improved airless blast wheel and feed means which are characterized by:

(1) greater stability and less vibration in use;
(2) greater strength;
(3) ease in replacement of parts;
(4) control of the blast pattern with means to increase the length of the pattern;
(5) greater stability and distribution of the blast pattern;
(6) control of the flow rate of the particulate media and the power utilized by the wheel to project a selected flow rate of particulate media; and
(7) improved means for feeding particulate media for increased flow rate and increase in the lengths of the blast pattern, with corresponding increase in the output efficiency of the wheel.

These and other objects and advantages of this invention will hereinafter appear, and for purposes of illustration, but not of limitation, an embodiment of the invention is shown in the accompanying drawings, in which.

Figure 1:
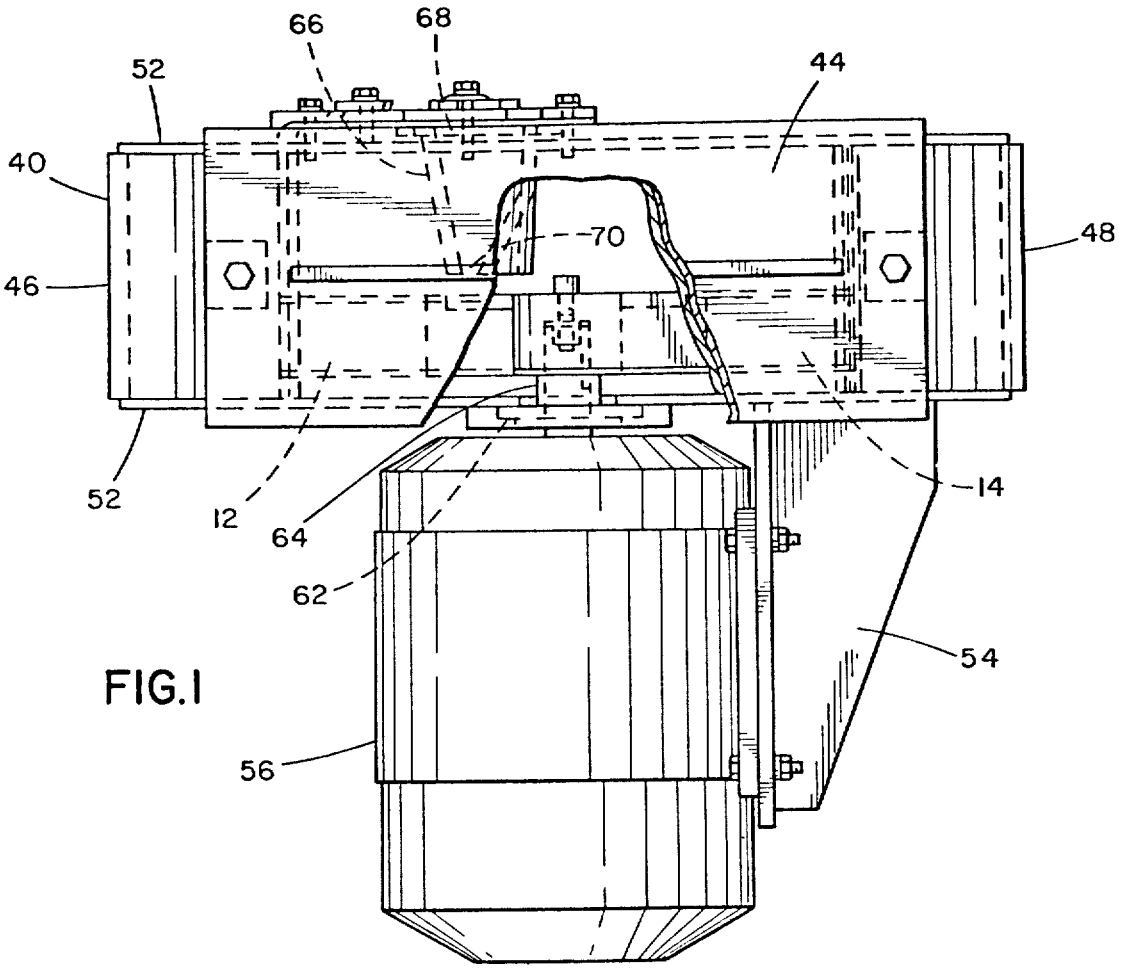
FIG. 1 is a side elevational view of a wheel assembly embodying the features of the invention described and claimed in the forementioned patent application, with portions broken away to show elements in the interior thereof.

Referring now to FIGS. 3 to 7 of the drawings, illustration is made of the two-bladed wheel comprising a central hub 10 and a pair of blades 12 and 14 extending outwardly in parallel relation in opposite directions from the hub 10, from portions of the hub on opposite sides of the axis and spaced from the axis by an equal amount to provide a balanced wheel.

The two-bladed wheel is mounted for movement about an axis by means of a bushing 16 which is received in fitting relation within an axial bore 18 through a portion of the hub and which, in turn, is mounted on the end of a motor driven shaft 20 which extends through an axial opening 22 in the hub in contiguous relation with the bore 18. The bushing is provided with a key 24 adapted to be received in fitting relationship within a keyway 26 in the hub for replaceably mounting the two-bladed wheel on the bushing for rotational movement therewith.

Figure 2:
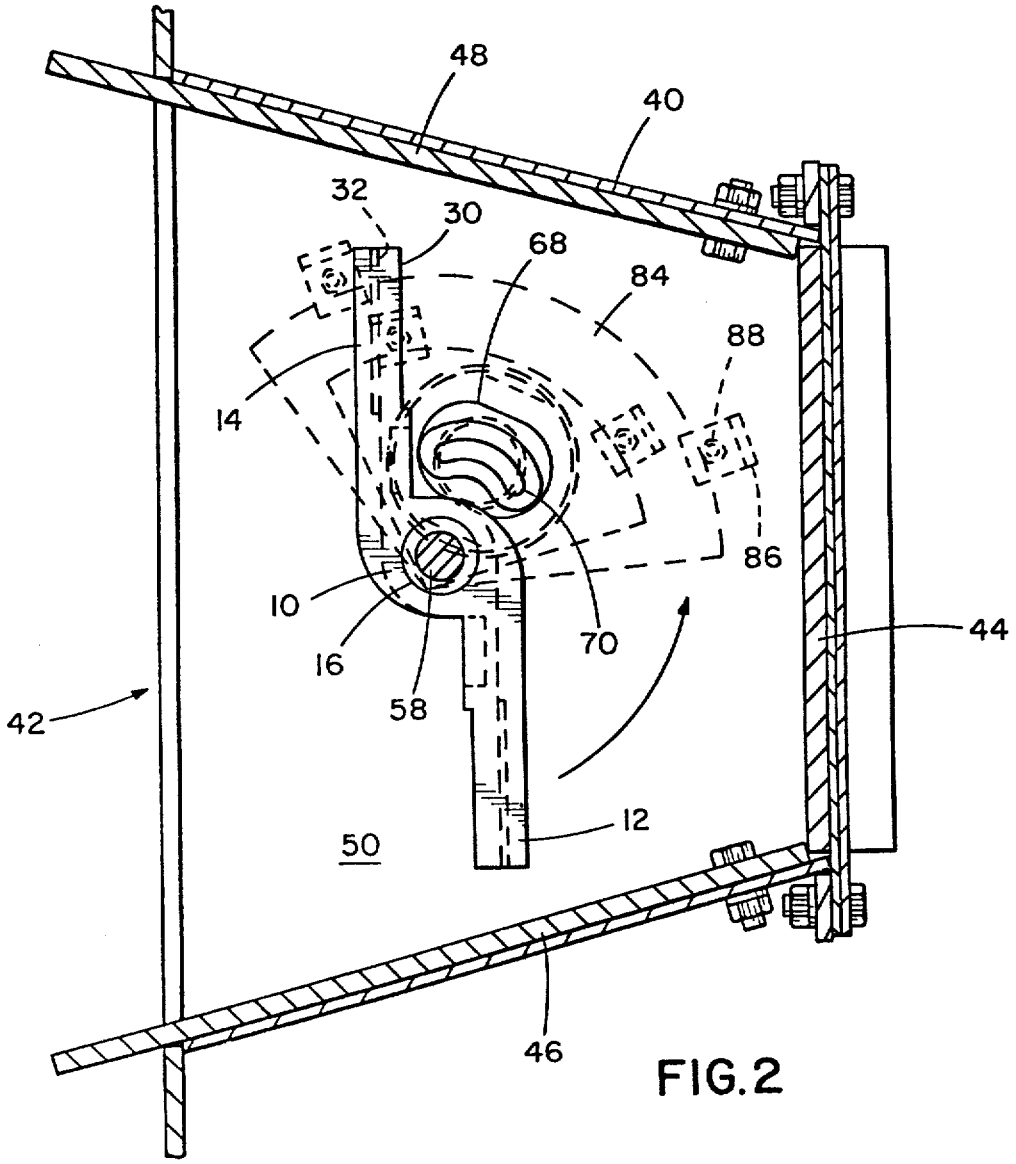
FIG. 2 is a sectional view taken along line 2—2 of FIG. 1.

The surfaces 28 of the blades 12 and 14, facing in the direction of rotational movement, indicated by the arrow in FIG. 2, constitute the front face adapted to engage the particulate media and over which the particulate media is displaced outwardly for projection from the ends of the blades in response to rotational movement of the wheel at high speed.

The front face 28 of each blade 12 and 14 is formed with a rib 30 which projects from the front face along the lower edge substantially throughout the length thereof. A similar rib 32 of lesser depth extends from the upper edge of the front face substantially throughout the length thereof except for a short inner section adjacent the hub 10 in circumferential alignment with the outlet from the feed tube through which particulate media flow into the path of the inner end portion of the blades for engagement thereby during rotational movement of the wheel.

In the preferred practice of this invention, the two-bladed wheel is formed in one piece to enable easier assembly while providing a stronger wheel which remains well balanced during use and thereby to provide for greater stability and less vibration during operation.

The blades 12 and 14 are usually straight members of rectangular shape having a width within the range of 1.5-4 inches and a length within the range of 3-10 inches. The ribs or flanges 30 and 32 operate to confine the particulate media for travel along the face of the blade and to minimize stray of particulate media over the edges of the blades.

As illustrated in FIGS. 1 and 2, the two-bladed wheel is mounted within a shroud 40 having an open side 42 through which particulate media is projected by the wheel. In the illustrated modification, the shroud is of trapezoidal shape with a back wall 44, angularly extending side walls 46 and 48 and trapezoidally shaped bottom and top walls 50.

A bracket 54 mounts an electric motor 56 from the bottom wall 50 of the shroud with the shaft 58 of the motor extending through the bottom wall for receipt of the bushing 16 on the through extending portion thereof and which is adapted to be secured thereon, as by means of a cap screw 60. A rubber seal 62 is provided between the motor housing and the bottom wall 50 of the shroud and a sealing gasket 64 is provided about the shaft portion extending through the bottom wall for protection from the abrasive media.

An important concept of this invention also resides in the configuration of the feed tube through which the particulate media is fed to the wheel. In the past, use has been made of a tubular member of uniform cross section extending from the end of a hopper to a level which just clears the upper edge of the blades.

Because of the increasing velocity of the particulate media as it falls gravitationally downwardly through the feed tube, particulate media which fills the tube at the inlet only partially fills the tube at the outlet. It has been found that when the discharge end of the tube is only partially filled, erratic patterns result from the wandering action of the particulate media out of the feed tube.

The following tabulation gives the velocity and the density determinations made with the same particulate media for various lengths of fall through a feed tube having a 1.5 inch orifice and from an initial velocity of 92 ft./min. and a K factor for the friction of the tube walls of 0.5.

| Distance of Fall | Velocity out of Discharge End of Tube | Exit Density out of Tube |
|---|---|---|
| 3" | 193.5 ft/min | 47.5% |
| 6" | 257.7 ft/min | 35.7% |
| 9" | 308.9 ft/min | 29.8% |
| 12" | 352.7 ft/min | 26.1% |
| 24" | 490.2 ft/min | 18.8% |

The erratic action has been overcome, in accordance with the practice of this invention, by the use of a feed tube of a configuration which diminishes in cross section from the inlet end to the discharge end whereby the density of the particulate media at the discharge end is at substantially maximum density. This provides for a smooth feed of particulate media at a uniform rate which calculates out to be a maximum rate with corresponding movement in the pattern of the blast.

It has also been found that the pattern thrown by the blades can be markedly lengthened to provide for greater coverage and more efficient operation by configuration of the discharge from the feed tube to lengthen the discharge of particulate media somewhat in the direction of rotation of the blades. This has the effect of increasing the time of flow of particulate media onto the face of the blade with a resultant longer particulate blast pattern. In other words, the same inner area of the blade is adapted to engage successive amounts of particulate media during its rotational movement thereby to increase the length of the blade covered by particulate media during any one instant, with corresponding increase in the angle for projection of the particulate media from the blade.

Figure 8:
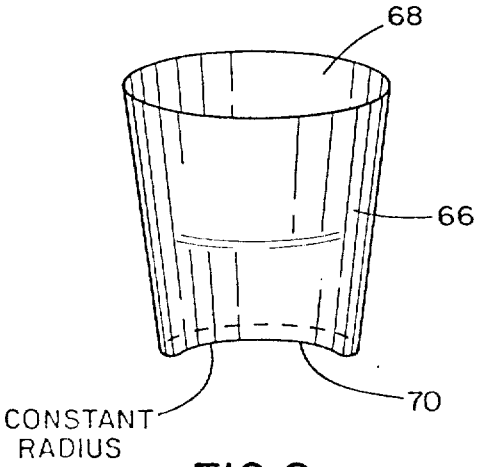
FIG. 8 is a perspective view of a feed tube embodying the features of this invention.

As illustrated in FIGS. 1, 2 and 8, the preferred configuration is a feed tube 66 which tapers inwardly from the entrance end 68 to the discharge end 70 with the discharge end defining an orifice of crescent shape arranged to extend circumferentially to the axis of rotation of the wheel or to extend lengthwise in the direction of rotation of the blade.

Figure 9:
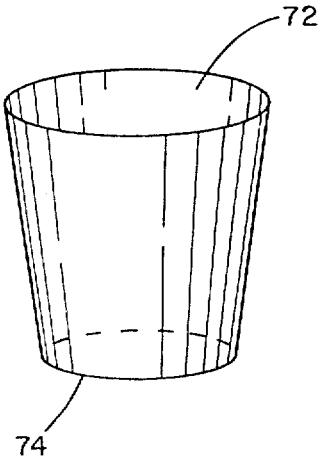
FIG. 9 is a perspective view of a modification in a feed tube embodying the features of this invention.

Instead, the desired effect can be obtained with a feed tube of the type shown in FIG. 9, in which the feed tube tapers inwardly from the inlet end 72 to the discharge end 74 with the outlet opening at the discharge end being of oblong or other geometric shape with the major dimension extending in the direction circumferentially of the axis or in the direction of rotation of the blade.

By way of a further ramification, the feed tube can be formed of two or more separate tubular members 76 and 78 of circular or polygonal cross section, each of which tapers inwardly from their inlet end 80 to the discharge 82 with the tubular members arranged circumferentially with respect to the axis of the wheel to discharge particulate media at variable distances from the blade for continuous engagement by the blade over a period of time during its rotational movement.

These arrangements have the effect of making increased use of the blade thereby to increase the output of the wheel, while, at the same time, increasing the area covered by the abrasive blast.

In the construction described in the aforementioned copending application, as illustrated in FIGS. 1 and 2, the feed tube 66 extends through an opening in the top plate of the shroud to a level immediately above the upper inner edge of the blade. The feed tube is supported by a plate 84 that is fastened to the top surface of the top plate, as by means of lock washers 86 held down by cap screws 88. Particulate media is fed to the inlet of the feed tube 66 from a hopper (not shown) in communication therewith for gravity flow of particulate media from the hopper into the feed tube.

In operation, the wheel is rotated at high speed. The article to be treated by particulate media thrown from the wheel is positioned in front of the open side 42 of the shroud. Particulate media which falls from the discharge end of the tube 66 is engaged by the face of the blades rotating at high speed. Upon engagement with the face of the rotating blades, the particulate media is centrifugally displaced over the face of the blade and is thrown with high centrifugal force from the ends thereof, through the open side 42 onto the article in front thereof.

It will be understood that the wheel shaft can be driven in rotational movement by conventional means other than an electrical motor, for example, as by an internal combustion engine, magnetic drive, or by indirect belt or gear drive. Similarly, the shroud can vary in shape as long as it substantially encloses the wheel except for the open side wall for projection of the particulate media therethrough. The wheel can be mounted for rotational movement about a vertical axis or a horizontal axis or any angle in between.

The wheel assembly described constitutes a low cost airless blast device which is easy to operate and which utilizes minimum space and supporting equipment. The spent abrasive or other particulate media can be recovered in the usual manner for reuse, preferably after removing dust and dirt as by means of a screen, air wash, and/or magnetic separator.

When it is desired to remove the wheel for replacement or repair, it is only necessary to remove the wheel from the shaft, with or without the bushing, and to replace the wheel by reversal of the operation.

The described features are not restricted to a vertical feed to wheel blades mounted for rotational movement in a horizontal plane. It has been found that similar results can be obtained with a wheel mounted to rotate about a substantially horizontally disposed axis or along any angle between vertical and horizontal. It is required, however, to divert the vertical flow of particulate material from downward flow through the tubular member and through a hollow member which extends crosswise and which includes the concept of decreasing cross section to a discharge opening of the type described which faces laterally in the direction towards the adjacent outer edge of the blades to feed the particulate material onto the blades in circular alignment with the inner end portions of the blades.

The above will hereinafter be described with reference to a two-bladed wheel of the type described mounted for rotational movement of the wheel about a horizontal axis for rotation of the blades in a vertical plane. It will be understood that the angle of the wheel can be varied for rotation about a vertical or horizontal axis or any angle therebetween.

Figure 11:
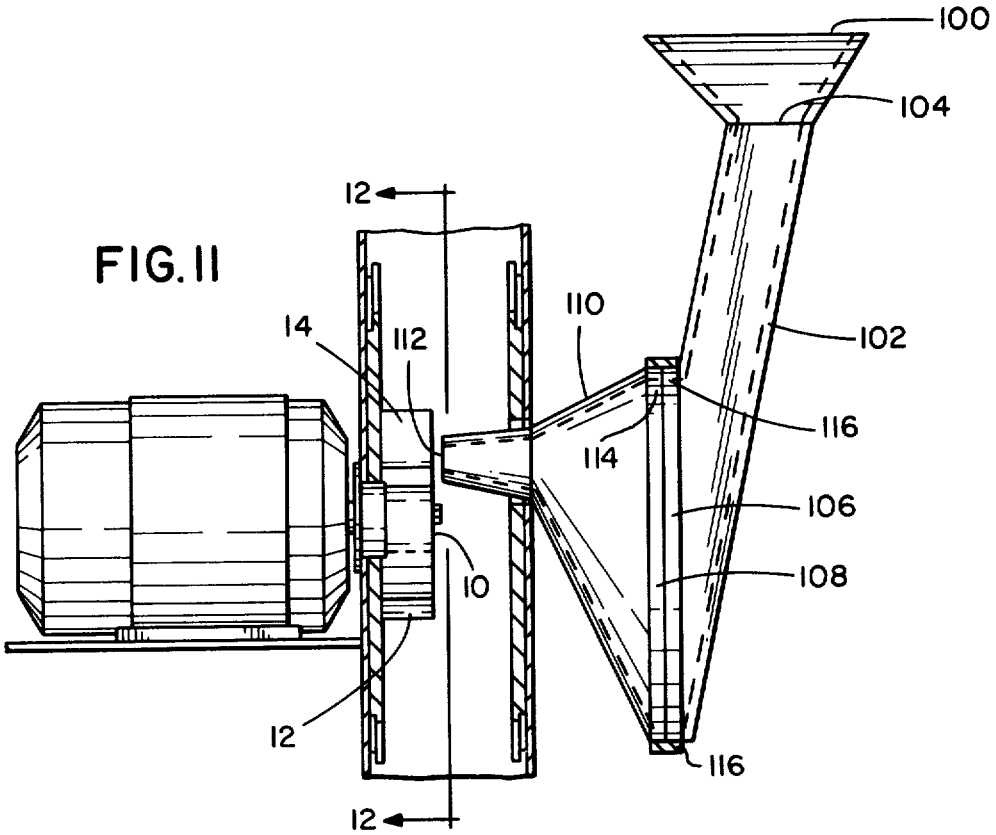
FIG. 11 is a front elevational view showing the wheel and feed mounted for rotational movement about a horizontally disposed axis.
Figure 12:
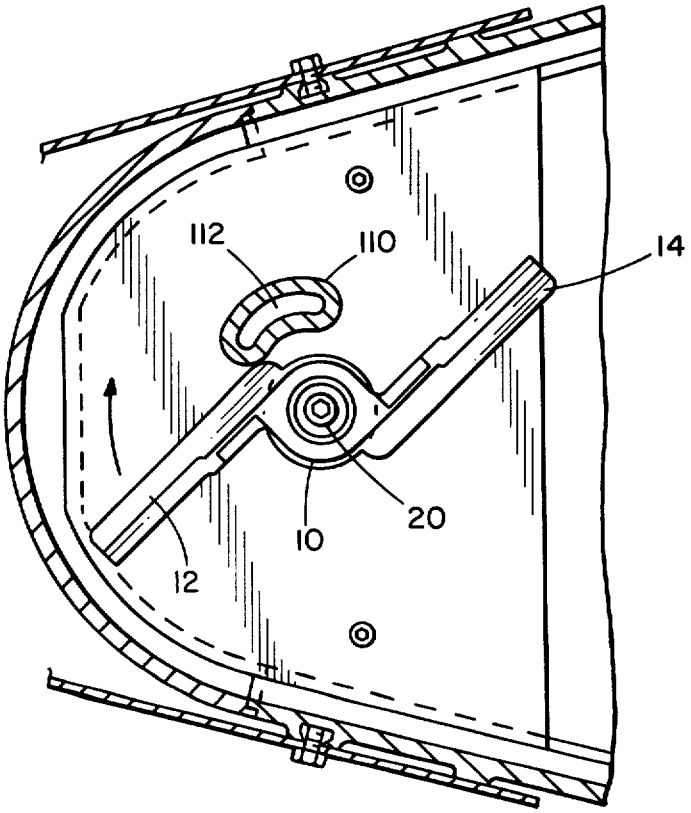
FIG. 12 is a schematic side elevational view showing the relation between the wheel blades and the feed opening in a wheel of the type shown in FIG. 11.

The above arrangement is illustrated in FIGS. 11 and 12 wherein the blades 12 and 14, extending radially outwardly from the hub 10, are mounted on shaft 20 for rotational movement by the electrical driven motor 56 about their horizontal axis.

In the modification shown in FIGS. 11 and 12, the particulate material is fed into the funnel 100 which directs the particulate material into the open upper end of a feed tube 102, in the form of a tubular member having a circular opening 106 in the inner side wall in crosswise alignment and in full communication with an outer open end 108 of a conically shaped hollow body 110 having a discharge opening 112 at its inner apex end in facing relation with the blades. At least the portion of the hollow body leading into the discharge opening is of the diminishing cross section, as heretofore described for maintaining uniform flow and control of the particulate material fed onto the blades.

Figure 10:
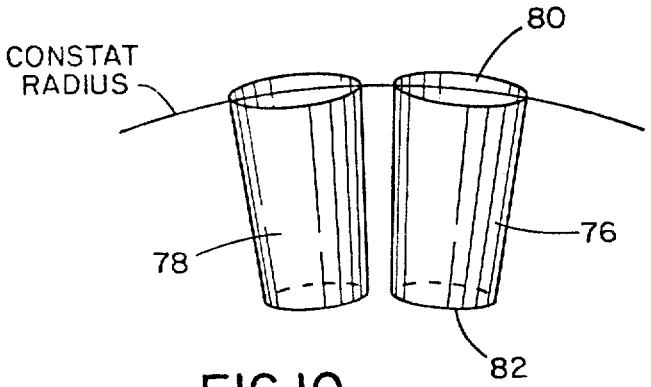
FIG. 10 is a perspective view of a further modification in a feed tube embodying the features of his invention.
Figure 3:
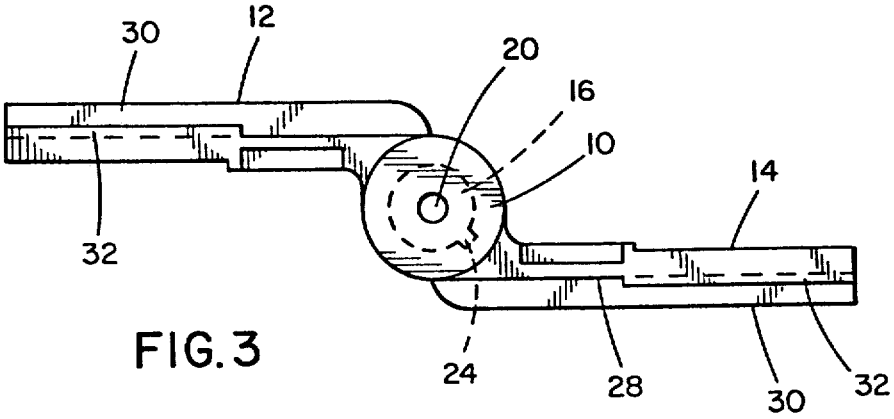
FIG. 3 is a top plan view of the two-bladed wheel shown in FIG. 1.
Figure 4:
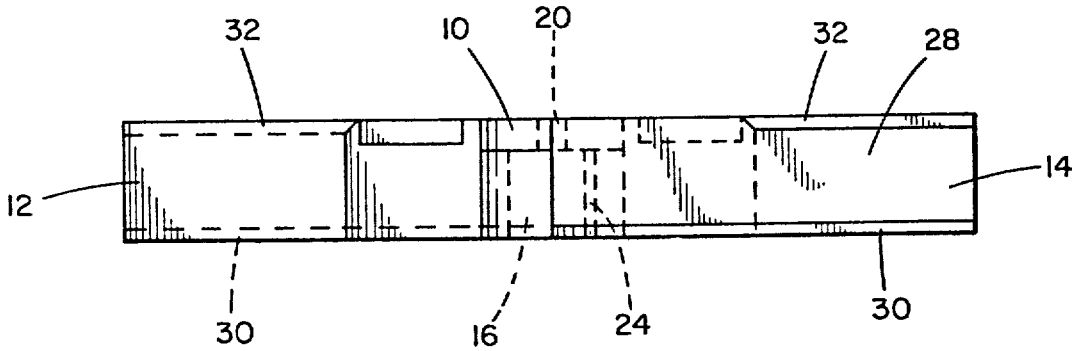
FIG. 4 is a side elevational view of the two-bladed wheel of FIG. 3.
Figure 5:
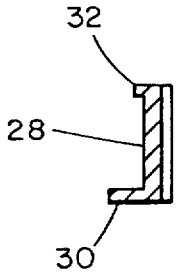
FIG. 5 is a sectional view taken along the line 5—5 of FIG. 4.
Figure 6:
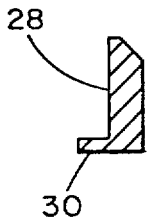
FIG. 6 is a sectional view taken along the line 6—6 of FIG. 4.
Figure 7:
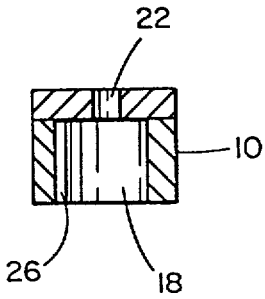
FIG. 7 is a sectional view taken along the line 7—7 of FIG. 4.

The discharge opening is of a configuration of the type heretofore described to prolong the feed of particulate material onto the inner end portions of the blades. Thus the blades engage successive portions of the particulate material issuing from the feed opening during rotational movement of the blades thereby to enlarge the pattern of particulate material projected from the ends of the blades. The various shapes of the feed openings elongated in the direction of rotational movement of the blades are illustrated in FIGS. 8, 9 and 10.

The conically shaped hollow body is preferably mounted on the tubular member for rotational movement relative thereto about an axis substantially in endwise alignment with the axis of the wheel with the outlet opening 112 offset for crosswise alignment with the inner end portions of the blades to feed the particulate material onto the inner end portions of the blades. By way of construction, the conically shaped hollow body can be adjusted for rotational movement about its axis to locate the feed opening 112 in any desired circumferential relation relative to the wheel thereby to enable substantially precise control over the direction of the particulate material thrown from the ends of the blades. For example, when the conically shaped hollow body is rotated to position the feed opening at the location shown in FIG. 12, the particulate material will be thrown in a spread pattern in a lateral direction. By rotation of the hollow body to locate the feed opening above the axis of the wheel, the pattern of particulate material thrown from the ends of the blades will be in a downward direction. Similarly, the hollow body can be rotated to vary the direction which will normally be in a direction about diametrically opposite the radial direction of offset of the feed opening from the axis of the wheel.

For rotational adjustment, the outlet opening 106 of the tubular member 102 and the inlet opening 108 of the hollow body 110 are formed of circular cross section with an annular flange 114 about the inlet in telescoping relation with an annular shroud 116 about the outlet opening to support the hollow body on the tubular member. The telescoping portions can be provided with openings 118 through which locking pins 120 can be inserted when aligned to interlock the members in their assembled and adjusted relation. Instead, the elements may be secured in the assembled relation by suitable clamps or other locking means.

It will be understood that changes may be made in the details of construction, arrangement and operation, without departing from the spirit of the invention, especially as defined in the following claims.

We claim:

1. A device for airless blast with particulate media comprising wheel blades mounted for rotational movement in a vertically disposed plane, means offset laterally from the plane of rotation of the blades for feeding particulate material from a feeding opening in crosswise alignment with the inner end portions of the blades to the inner end portions of the wheel blades for engagement by the blades during rotational movement of the wheel at high speed whereby the engaged particulate media is projected from the ends of the blades comprising a vertically disposed tubular member having vertically disposed side walls and an inlet opening at the top and an opening in the vertically disposed side wall below the inlet and a horizontally disposed hollow body having an open end portion extending from and in registry with the opening in the side wall of the tubular member and a feed opening in an end portion facing the wheel blades and laterally offset from the lateral edges thereof for flowing particulate media from the inlet, through the tubular member and hollow body onto the inner end portions of the blades.

2. A device as claimed in claim 1 in which the opening in the side wall is circular and the hollow body is circular in cross section and of decreasing diameter from the open end in registry with the side wall opening of the tubular member to the feed opening and having its axis substantially horizontally disposed along the line equidistant from the side of the member with the open end portion at the base in communication with the opening in the side wall of the tubular member and with the feed opening at the apex.

3. A device as claimed in claim 2 which includes means for mounting the hollow body for rotational movement about a horizontal axis to enable adjustment of the feed opening circumferentially relative to the bladed wheel.

4. A device as claimed in claim 3 which includes an annular shroud about the opening in the side wall of the tubular member and an annular flange on the hollow body which receives the shroud in telescoping relation and means for latching the hollow body in its adjusted relation.

5. A device as claimed in claim 1, in which the wheel is a one piece wheel.

6. A device as claimed in claim 1, in which the blades extend tangentially in opposite directions from diametrically opposed sides of the hub.

7. A device as claimed in claim 1, in which the blades extend in spaced parallel planes.

8. A device as claimed in claim 1, in which the blades have a front face and a back wall and which includes a flanged portion extending perpendicularly from the lower edge portion of the front face substantially throughout the length of the blade and a flanged portion extending perpendicularly from the upper edge portion of the front face from an inner end spaced a short distance from the hub to the outer end.

9. A device for airless blast with particulate media comprising a housing having an open side, a two-bladed wheel mounted within the housing for rotational movement about the central horizontally disposed axis, means for imparting rotational movement to the wheel, a means offset laterally from the plane of rotation of the blades for feeding particulate media from a feed opening in crosswise alignment with the end portions of the blades onto the inner end portion of the blades but offset laterally from the central axis, comprising a vertically disposed tubular member having vertically disposed side walls and an inlet opening at the top and an opening in the side wall below the inlet, a horizontally disposed hollow body having an open end portion in registry with the opening in the side wall of the tubular member and a feed opening in an end portion facing the wheel blades and laterally offset from the lateral edges thereof for flowing particulate media from the inlet through the tubular member and hollow body onto the inner end portion of the blades whereby the engaged particulate media is displaced centrifugally over the face of the blades and projected from the blades through the open side.

10. A device as claimed in claim 9, in which the wheel is a one piece wheel.

11. A device as claimed in claim 9, in which the blades extend tangentially in opposite directions from diametrically opposed sides of the hub.

12. A device as claimed in claim 9, in which the blades extend in spaced parrallel planes.

13. A device as claimed in claim 9 in which the hollow body is of decreasing cross section, and in which the feed opening has a lengthwise dimension in the direction of the rotation of the wheel that is greater than the crosswise dimension whereby the time of flow of media onto the face of the blade is increased thereby to increase the length of the coverage of the media thrown from the outer ends of the blades.

14. A device as claimed in claim 13, in which the means for imparting rotational movement to the wheel within the housing comprises a shaft which extends through 2 side wall of the housing, means for removably mounting the hub of the wheel onto the through extending portion of the shaft for conjoint rotational movement and means for imparting rotational movement to the shaft.

15. A device as claimed in claim 13, in which the feed opening is of crescent shape with the lengthwise dimension extending in the direction of rotation of the wheel.

16. A device as claimed in claim 13, in which the feed opening is in the shape of an oblong with the major dimension in the direction of rotation of the wheel.

17. A device as claimed in claim 9 in which the opening in the side wall is circular and the hollow body is circular in cross section and of decreasing diameter from the open end in registry with the side wall opening of the tubular member to the feed opening having its axis substantially horizontally disposed along a line equidistant from the side of the member with the open end portion at the base in communication with the opening in the side wall of the tubular member and with the feed opening at the apex.

18. A device as claimed in claim 9 in which the axis of the hollow body is aligned with the axis of the wheel with the feed opening offset from the axis for crosswise alignment with the inner end portions of the blades.

19. A device as claimed in claim 9 which includes means for mounting the hollow body for rotational movement about a horizontal axis to enable adjustment of the feed opening circumferentially relative to the bladed wheel.

20. A device as claimed in claim 9 which includes an annular shroud about the opening in the side wall of the tubular member and an annular flange on the hollow body which receives the shroud in telescoping relation and means for latching the hollow body in its adjusted relation.

* * * * *